US007563154B2

(12) United States Patent
Oota et al.

(10) Patent No.: US 7,563,154 B2
(45) Date of Patent: Jul. 21, 2009

(54) GRINDING APPARATUS HAVING SLUDGE-REMOVING DEVICE AND METHOD OF REMOVING SLUDGE

(75) Inventors: Mitsuo Oota, Nishio (JP); Toshiyuki Yasuda, Okazaki (JP); Makoto Yuitou, Hazu-gun (JP); Kouichi Kobayashi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/730,737

(22) Filed: Apr. 3, 2007

(65) Prior Publication Data

US 2007/0275642 A1 Nov. 29, 2007

(30) Foreign Application Priority Data

Apr. 5, 2006 (JP) ..... 2006-104613

(51) Int. Cl.
*B24B 1/00* (2006.01)

(52) U.S. Cl. ..... 451/53; 451/231; 451/450

(58) Field of Classification Search ..... 451/53, 451/56, 449, 450, 54, 178, 180, 231
See application file for complete search history.

(56) References Cited

U.S. PATENT DOCUMENTS 3,167,893 A 2/1965 Giardini et al.
4,545,152 A * 10/1985 Grimm ..... 451/242
4,854,087 A * 8/1989 Riha ..... 451/541
5,111,625 A * 5/1992 Simpfendorfer et al. .... 451/450
5,961,376 A 10/1999 Gottschald
5,993,297 A * 11/1999 Hyatt et al. ..... 451/53
6,312,319 B1 * 11/2001 Donohue et al. ..... 451/56
6,454,636 B1 * 9/2002 Iwabuchi ..... 451/53
6,585,564 B1 * 7/2003 Hiramoto et al. ..... 451/7

(Continued)

FOREIGN PATENT DOCUMENTS

EP 0 854 010 A1 7/1998

(Continued)

OTHER PUBLICATIONS

German Examination Report dated Jun. 26, 2007 in Application No. 10 2007 000 208.6 together with an English translation.

(Continued)

*Primary Examiner*—Eileen P. Morgan
(74) *Attorney, Agent, or Firm*—Nixon & Vanderhye PC

(57) ABSTRACT

A work having a portion to be ground, such as a tapered surface, is ground by a grinder driven by a driving device. During grinding operation, coolant is supplied to a grinding surface of the grinder and the portion to be ground. After the grinding operation is completed, the coolant is continued to be supplied for removing sludge on the grinder while the grinder is leaving the work and returning to its original position. The coolant may be pressurized to a higher level when it is supplied for removing the sludge than when it is supplied during the grinding operation. The number of works that have been already ground may be counted, and the coolant for removing the sludge may be supplied only when the number of works exceeds a predetermined number. Alternatively, the sludge is removed by brushing when the number of works does not reach the predetermined number.

15 Claims, 4 Drawing Sheets

U.S. PATENT DOCUMENTS

| | | | | |
|---|---|---|---|---|
| 7,153,187 | B2 * | 12/2006 | Ahti et al. | 451/6 |
| 2004/0029510 | A1 * | 2/2004 | Yoshimi et al. | 451/450 |

FOREIGN PATENT DOCUMENTS

| | | |
|---|---|---|
| JP | 5-131367 | 5/1993 |
| JP | 2000-246639 | 9/2000 |
| JP | 2004-351599 | 12/2004 |

OTHER PUBLICATIONS

Chinese Office Action dated Oct. 10, 2008, issued in counterpart Chinese Application No. 200710092065.3, with English translation.

* cited by examiner

GRINDING APPARATUS HAVING SLUDGE-REMOVING DEVICE AND METHOD OF REMOVING SLUDGE

CROSS-REFERENCE TO RELATED APPLICATION

This application is based upon and claims benefit of priority of Japanese Patent Application No. 2006-104613 filed on Apr. 5, 2006, the content of which is incorporated herein by reference.

BACKGROUND OF THE INVENTION

1. Field of the Invention

The present invention relates to a grinding apparatus, and more particularly to a sludge-removing device and a method of removing sludge.

2. Description of Related Art

A grinding apparatus, in which grinding operation is performed while supplying coolant to a surface to be ground and a grinder surface, has been known hitherto. Grinders, such as a conductive grinder made by binding grinder particles such as diamond particles with an electric-conductive binder or an electrodeposited grinder made by fixing grinding particles by electrolytic deposition, has been used. Sludge accumulated on the grinder in grinding operation has to be removed to recover sharpness of the grinder.

JP-A-5-131367 discloses a method of removing sludge from the grinder by brushing a grinding surface with a carbon brush or the like. In this brushing method, it is necessary to use a brush having thin wires to remove small sludge particles from the grinder. The brush has a relatively short life because the thin wires easily wear. JP-A-2004-351599 discloses a method of removing the sludge by means of ultrasonic energy of coolant that is oscillated by an ultrasonic oscillator. In this method, however, an expensive ultrasonic oscillator is required.

SUMMARY OF THE INVENTION

The present invention has been made in view of the above-mentioned problems, and an object of the present invention is to provide an improved grinding apparatus, in which sludge accumulated on a grinder is easily and inexpensively removed. Another object of the present invention is to provide an improved method of removing sludge from the grinder.

The grinding apparatus includes a grinder driven by a driving device, a holder for fixedly holding a work, and a coolant-supplying device. The grinder has a grinding surface that contacts a portion of the work to be ground. During grinding operation, coolant is supplied to the grinding surface and the portion to be ground. The coolant is continued to be supplied to the grinding surface of the grinder while the grinder is leaving the work and returning to its original position after the grinding operation has been completed. Sludge accumulated on the grinding surface is removed by injecting the coolant to the grinding surface.

Preferably, the pressure of the coolant is set to a higher level when it is supplied to the grinding surface for removing the sludge than when it is supplied during the grinding operation. The portion to be ground may be a tapered surface, and the grinding surface may be a conical surface contacting the tapered surface during the grinding operation. The coolant may be supplied through a passage formed in the work. The number of works that have been ground may be counted, and the coolant for removing the sludge is supplied only when the number of works exceeds a predetermined number. It is also possible to remove the sludge by brushing when the number of works ground is less than the predetermined number. The driving device and the coolant-supplying device may be controlled in related timing by a controller including a microcomputer.

According to the present invention, the same coolant that is used in the grinding operation is supplied to the grinder for removing the sludge on the grinder when the grinder is leaving the work and returning to its original position. Therefore, the sludge is surely removed in a simple and inexpensive manner. Other objects and features of the present invention will become more readily apparent from a better understanding of the preferred embodiments described below with reference to the following drawings.

DETAILED DESCRIPTION OF THE PREFERRED EMBODIMENTS

Figure 1:
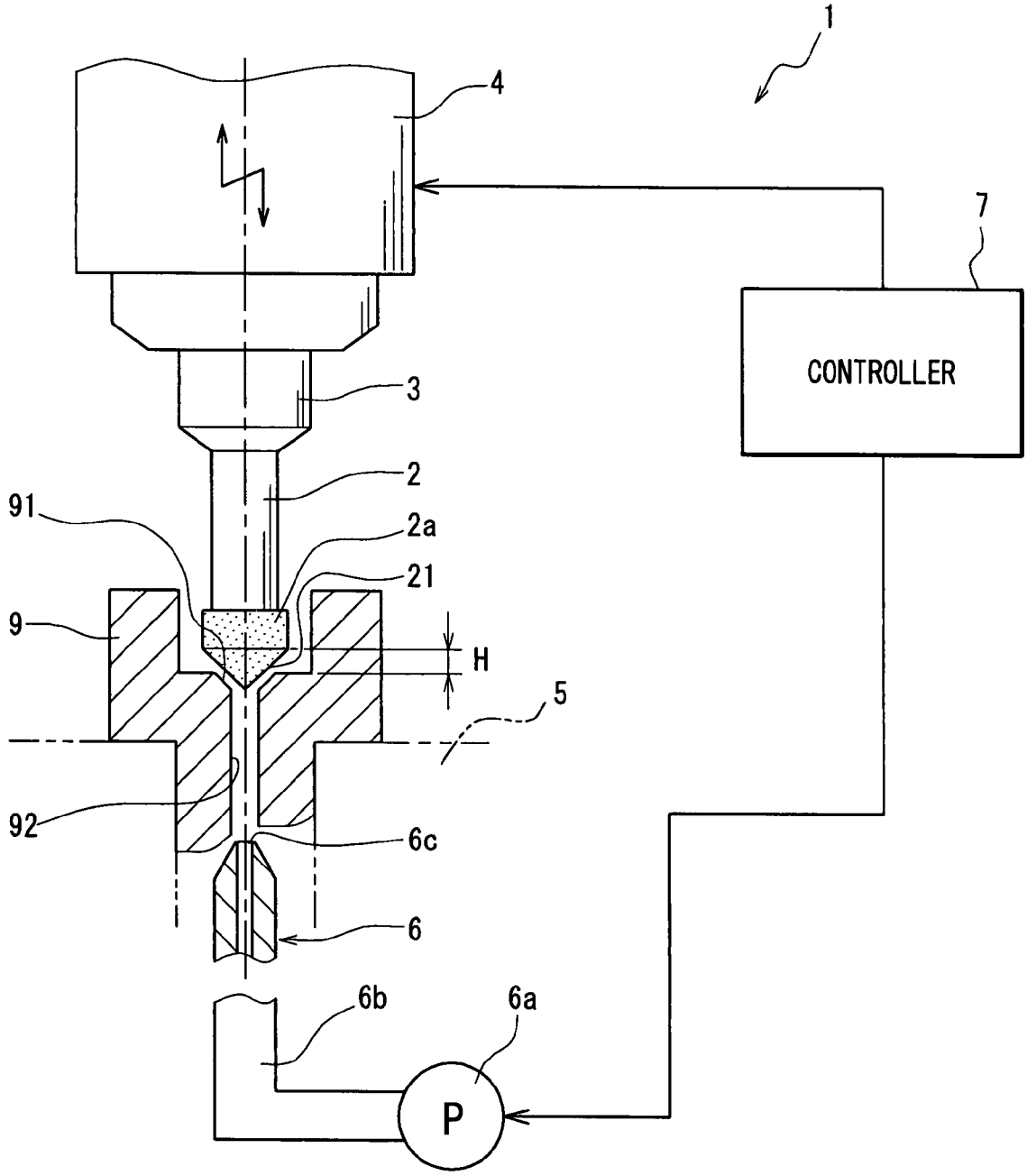
FIG. 1 is a side view (partially cross-sectioned) showing a grinding apparatus according to the present invention.

A first embodiment of the present invention will be described with reference to FIGS. 1-4. First, referring to FIG. 1, an entire structure of a grinding apparatus 1 will be described. Though the grinding apparatus 1 is vertically positioned in FIG. 1, it is, of course, possible to position it horizontally. The grinding apparatus 1 is composed of a driving device 4 for driving grinder shaft 2 to which a grinder 2*a* is connected, a coolant-supplying device 6 including a coolant source 6*a* and a supply tube 6*b*, and a controller 7 that controls operation of the driving device 4 and the coolant-supplying device 6. The grinder shaft 2 is chucked by a chuck 3. As the grinder 2, the electrodeposited grinder or the conductive grinder, mentioned above, may be used. In this embodiment, the electrodeposited grinder is used.

A work 9 having a portion to be ground, which is a tapered surface 91 in this particular embodiment, is held by a holder 5. The grinder 2*a* has a grinding surface 21, which is a conical surface in this embodiment, and the grinding surface 21 contacts the tapered surface 91 thereby to grind the tapered surface. The work 9 includes a passage 92 through which the coolant is supplied to the grinding surface 21 and the tapered surface 91. As illustrated in FIG. 1. the grinding surface 21 engages the tapered surface 91 around the entirety of the opening of passage 92. The coolant-supplying device 6 has an opening 6*c*, through which the coolant is injected into the passage 92. The supply tube passage including the opening 6*c* may be inclined with respect to the passage 92 as long as the coolant is supplied to the grinding surface 21 and the tapered surface 91. The coolant is pressurized in the coolant source 6*a* by a pump P to a predetermined pressure (e.g., 1 MPa).

The controller 7 includes a microcomputer and controls operation of the driving device 4 and the coolant-supplying device 6 under interrelated timing. The grinder 2*a* is lowered to a position contacting the tapered surface 91 in a grinding operation and is lifted to its initial position after the grinding operation is completed. The coolant is supplied to the grinding surface 21 and the tapered surface 91 during the grinding operation. The coolant is supplied to the grinding surface 21 while the grinder 2*a* is leaving the tapered surface 91 after the grinding operation is completed in a manner described later in detail. All of these operations are controlled by the controller 7. The controller 7 also includes a device for counting the number of works that have been ground.

Figure 2:
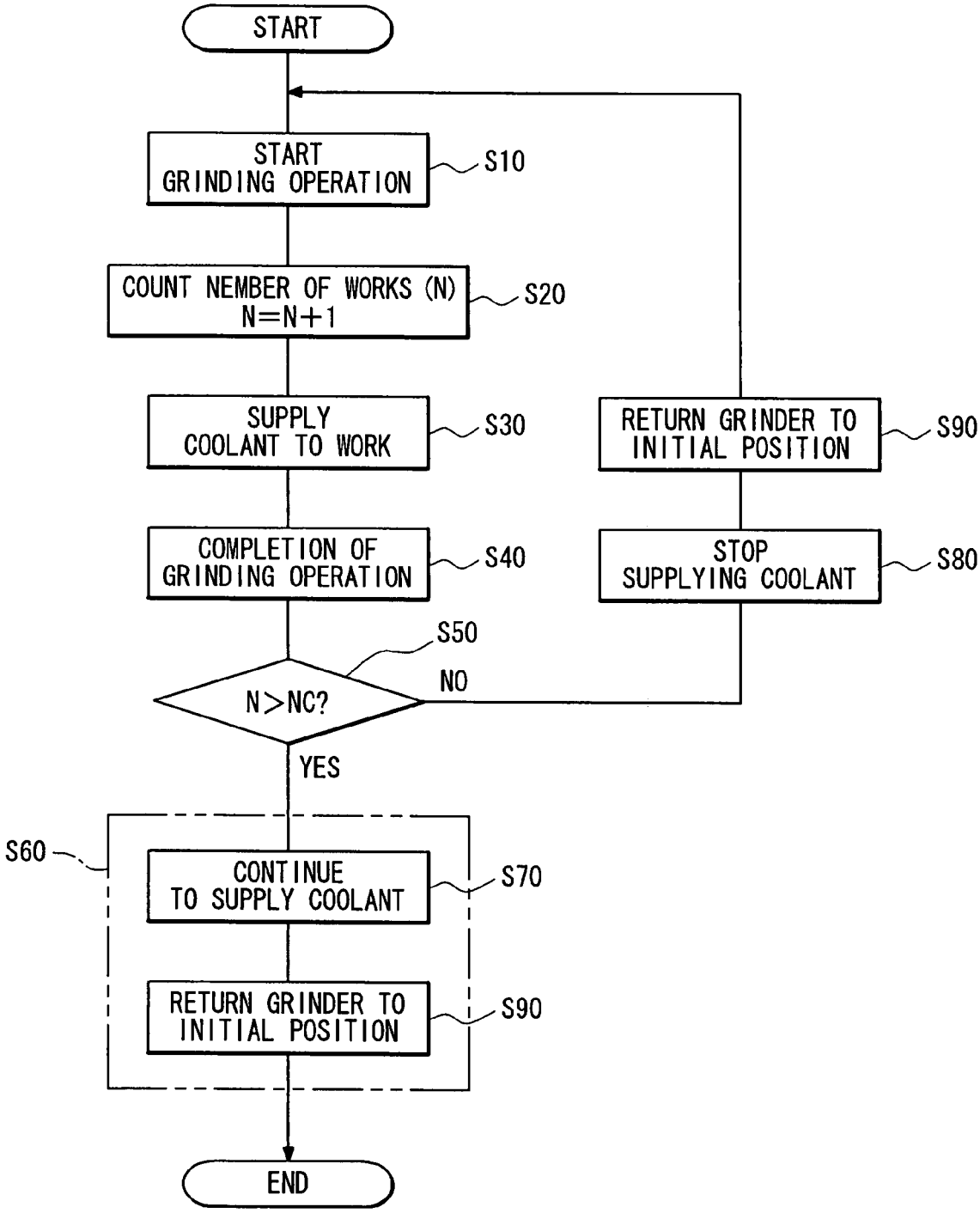
FIG. 2 is a flowchart showing a process of controlling the grinding apparatus as a first embodiment of the present invention.

A process of controlling the grinding apparatus will be described with reference to FIG. 2. The grinding operation may be performed in several steps, e.g., steps of rough grinding, intermediate grinding and finish grinding. FIG. 2 shows an exemplary process in which a single grinding operation is performed for simplifying explanation.

The work 9 is firmly held by the holder 5. Then, the grinding operation starts at step S10. At the next step S20, a present work number is incremented by adding one (1) to the number of works (N) that have been ground (N=N+1). At step S30, the coolant is supplied to the grinding surface 21 of the grinder 2*a* and the tapered surface 91 (a portion to be ground). The tapered surface 91 is ground by pressing down the grinder 2*a* by a predetermined amount. At step S40, the grinding operation is completed. At step S50, whether or not the number of works that have been ground by now exceeds a predetermined number (NC). That is, whether N is larger than NC is determined. If N is larger than NC, the process proceeds to sludge-removing step S60 that includes steps S70 and S90. If not, the process proceeds to step S80.

If NC pieces of works 9 can be successfully ground by a new grinder 2*a* without removing the sludge, the predetermined number is set to such a number NC. In other words, the grinding sludge on the grinding surface 21 has to be removed when NC pieces of works have been ground in order to attain successful grinding results. The predetermined number NC may be set to, e.g., several-tens.

If it is determined that N is smaller than NC, the process proceeds to step S80, where supply of the coolant is stopped. At step S90, the grinder 2*a* is lifted upward and returned to its original position. Then, the process returns to step S10, where the grinding operation for the next work starts. If it is determined that N exceeds the predetermined number NC, the process proceeds to step S70, where supply of the coolant is continued after the grinding operation is completed. At step S90, the grinder 2*a* is lifted upward and returned to its original position, and the grinding surface 21 leaves the tapered surface 91 while the coolant is continued to be supplied. The sludge accumulated on the grinding surface 21 is removed by the coolant supplied to the grinding surface 21. Then, the process comes to the end.

Figure 3:
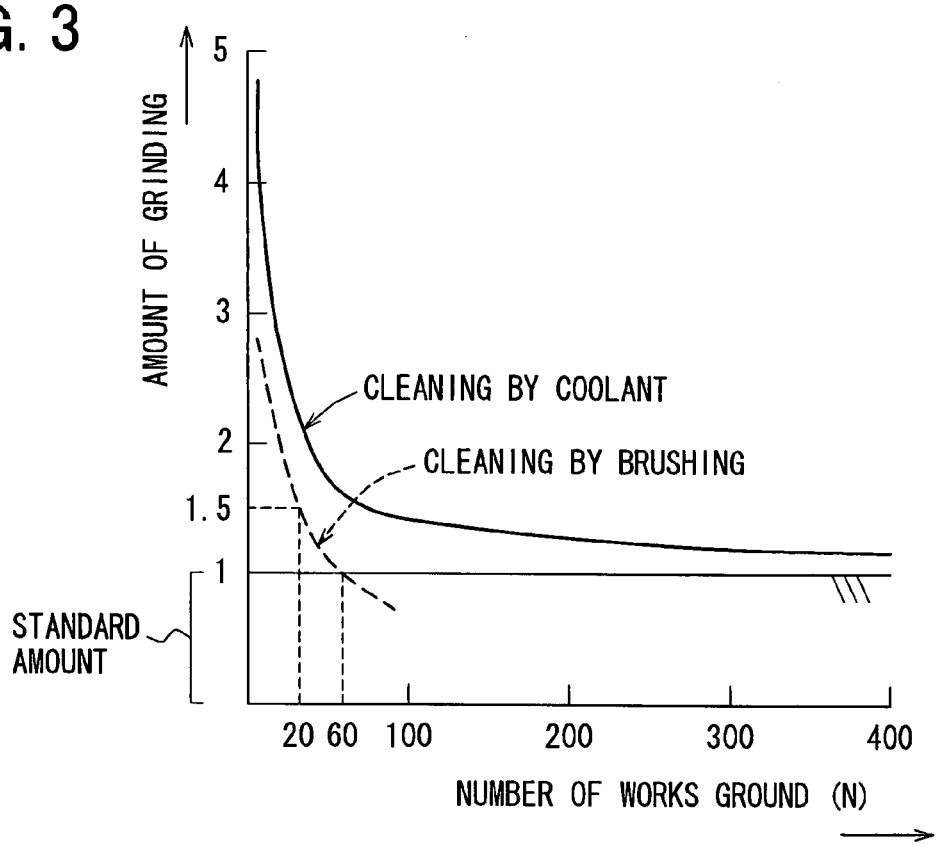
FIG. 3 is a graph showing an amount removed by grinding operation with a grinder, which is recovered after grinding the certain number of works.
Figure 6A:
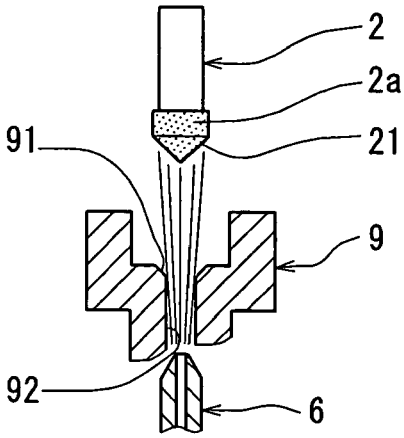
FIG. 6A is a schematic view showing a process of removing sludge from a grinder by injecting coolant.

With reference to FIG. 3, effects of cleaning (sludge-removing effects) by supplying coolant will be explained in comparison with cleaning by brushing. The cleaning of the grinder 2*a* by supplying coolant is performed in a manner sketched in FIG. 6A, while the cleaning by brushing is performed in a manner sketched in FIG. 6B. The coolant is supplied to the grinding surface 21 while the grinding surface 21 is leaving the tapered surface 91. The brushing is performed after the grinding surface 21 lifted from the tapered surface 91.

In FIG. 3, the number of works ground is shown in the abscissa and an amount of grinding (an amount of material removed by grinding) is shown in the ordinate. A solid line shows the amount of grinding when the grinder 2*a* is cleaned by the coolant, while the dotted line shows the same when the grinder 2*a* is cleaned by brushing. One (1) in the ordinate shows a standard amount of grinding, and other numbers in the ordinate shows comparisons with the standard amount.

The curves in FIG. 3 show the amount of grinding which is attained by cleaning the grinder when N pieces of the works have been ground. For example, in the case where the grinder is cleaned when N is very low (10 or lower), the amount of grinding is recovered to five times of the standard amount if the cleaning is done with the coolant. On the other hand, the amount of grinding recovered only to about 2.5 times of the standard amount if the cleaning is done by brushing. Similarly, in the case where the cleaning is done when N is 20, the amount of grinding is recovered to 2.5 times of the standard amount if the cleaning is done by the coolant, while it is recovered only to 1.5 times of the standard amount if the cleaning is done by brushing. In the case where the cleaning is performed when N is 60, the amount of grinding is much higher than the standard amount if the cleaning is done by the coolant, while it becomes the same level as the standard amount if the cleaning is done by brushing. The amount of grinding is recovered to a level higher than the standard amount even when the cleaning is performed when N is 400, for example, if the cleaning is done by the coolant.

Figure 4:
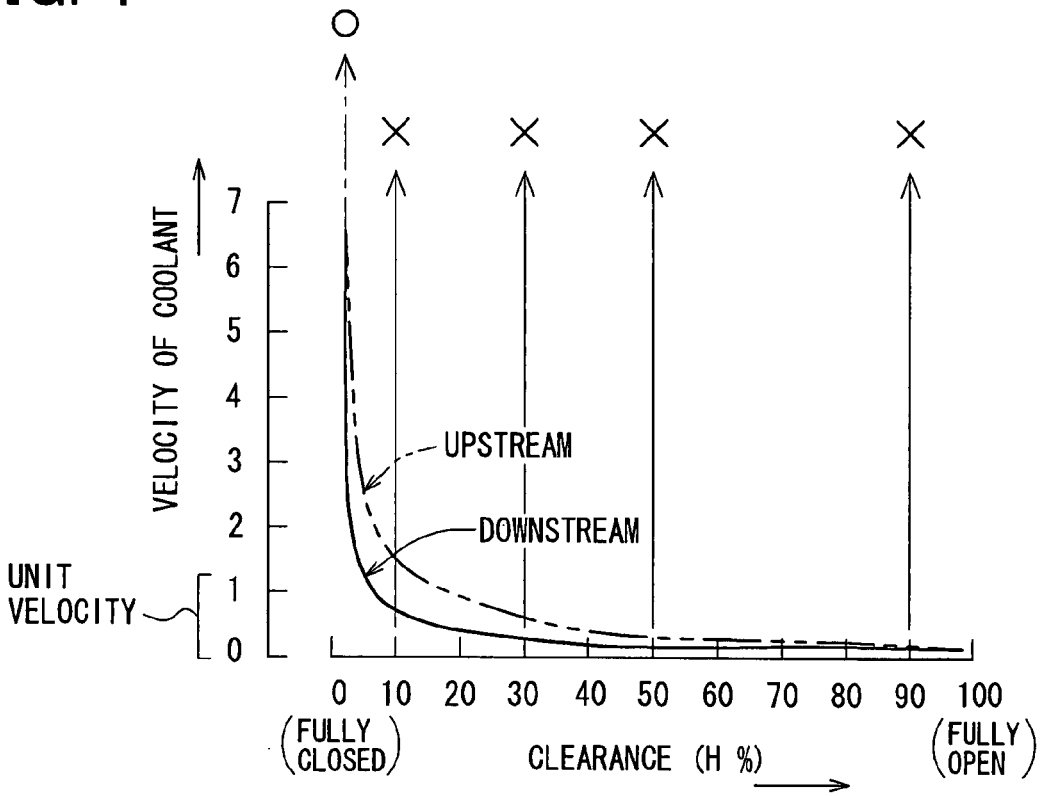
FIG. 4 is a graph showing a velocity of coolant versus a clearance through which the coolant is injected.

With reference to FIG. 4, a velocity of the injected coolant flowing through a clearance H (between the portion to be ground and the grinding surface 21 shown in FIG. 1) will be explained. In FIG. 4, the clearance H is shown in the abscissa in a percentage relative to a fully open clearance. At the fully open clearance, the velocity of the injected coolant becomes almost zero, while it becomes very high in the vicinity of the fully closed clearance. A velocity of the injected coolant is shown in the ordinate. A solid line shows the velocity at a downstream portion of the clearance H, and a dotted line shows the velocity at an upstream portion of the clearance H. One (1) in the ordinate shows an unit velocity, and other velocities in the ordinate are shown in comparison with the unit velocity.

In the case where the velocity is measured at fixed clearances (10, 30, 50 and 90 percents of the fully open clearance), the velocity is not high enough to sufficiently remove the sludge from the grinder (cross-marked). On the other hand, in the case where the velocity is measured while the grinder is leaving the tapered surface 91 (at a very small clearance H smaller than 5 percents), the velocity is sufficiently high to remove the sludge (circle-marked). This means that it is very effective to inject the coolant to the grinding surface 21 at a moment when the grinder 2*a* is leaving the portion to be ground.

Preferably, the pressure of the coolant is increased when it is injected to the grinding surface 21 for removing sludge than when it is supplied during the grinding operation. By injecting the coolant at a higher pressure to the grinding surface 21, effects of removing the sludge are enhanced. If the pressure of the coolant supplied during the grinding operation is too high, the grinding surface 21 is forcibly separated from the portion to be ground, and thereby dimensional accuracy of grinding is adversely affected.

Since the coolant is supplied also during the grinding operation, the grinding surface 21 is cleaned during the grinding operation. Since the coolant is supplied through the passage 92 formed in the work 9 in the embodiment described above, the coolant can be easily and directly injected toward the grinder 2*a*.

Figure 5:
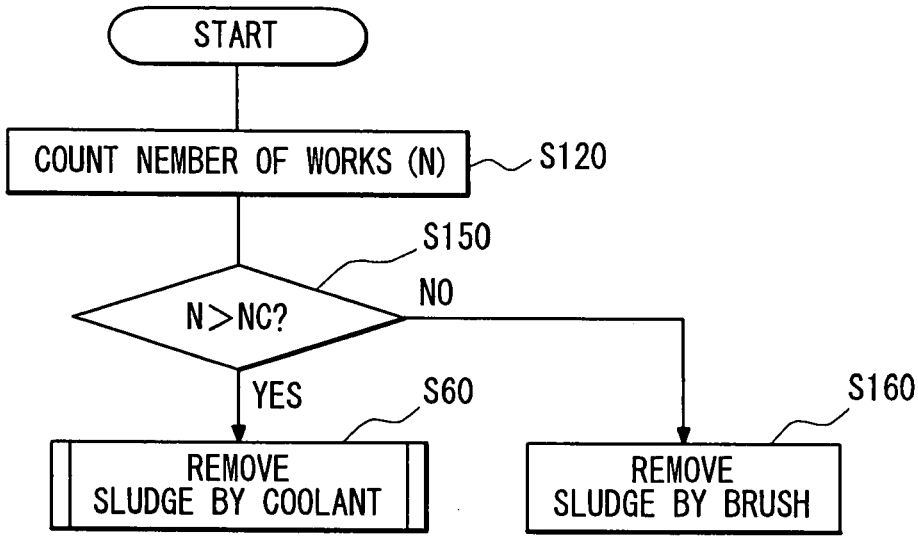
FIG. 5 is a flowchart showing a process of removing sludge from a grinder, as a second embodiment of the present invention.
Figure 6B:
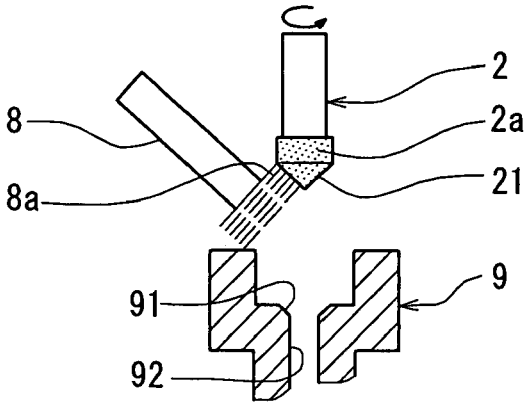
FIG. 6B is a schematic view showing a process of removing sludge from a grinder by brushing.

A second embodiment of the present invention will be described with reference to FIG. 5 showing a process of controlling the grinding apparatus 1. In this embodiment, the grinder 2*a* is cleaned either by a brush device 8 having a brush 8*a* (shown in FIG. 6B) or by injecting the coolant. At step S120 the number (N) of works 9 that have been ground is counted. At step S150, whether N is larger than a predetermined number NC is determined. If N is larger than NC, the process proceeds to step S60 (the same step as the step S60 shown in FIG. 2), where the sludge on the grinder 2*a* is removed by injecting the coolant while the grinder 2*a* is leaving the work 9 and returning to its original position. Preferably, the predetermined number NC in this embodiment is set to 20. If N is smaller than NC, the process proceeds to step S160, where the sludge on the grinding surface 21 is removed by brushing as shown in FIG. 6B. In this cleaning operation, the brush 8*a* is rotated.

As described above, the grinder 2*a* is cleaned by brushing if N is small, while it is cleaned by injecting the coolant if N is large. In this manner, it is avoided to over-clean the grinder to thereby grind the work too much. If the grinder becomes too sharp than originally planed, the work may be ground deeper than expected. The grinder 2*a* can be used for a long time in the manner described in FIG. 5.

The present invention is not limited to the embodiments described above, but it may be variously modified. For example, the portion to be ground is not limited to the tapered surface 91. The portion to be ground may be an inner peripheral surface or a semi-spherical surface of the work. While the present invention has been shown and described with reference to the foregoing preferred embodiments, it will be apparent to those skilled in the art that changes in form and detail may be made therein without departing from the scope of the invention as defined in the appended claims.

What is claimed is:

1. A grinding apparatus for grinding a work while supplying coolant to a portion to be ground, comprising:

a grinder driven by a driving device;

a holder for holding the work; and a coolant-supplying device for supplying coolant to the portion to be ground, wherein:

the coolant is continued to be supplied to a grinding surface of the grinder, after grinding operation is completed, while the grinder is leaving the work and returning to its initial position to thereby removing sludge on the grinding surface, wherein the coolant-supplying device includes a passage through the work to the portion to be ground, the grinder, the work and the passage of the coolant-supplying device are coaxially aligned, and the grinder engages the work around an entirety of an opening of the passage when the work is being ground.

2. The grinding apparatus as in claim 1, wherein:

a pressure of the coolant supplied for removing the sludge is set to a higher level than a pressure of the coolant supplied during the grinding operation.

3. The grinding apparatus as in claim 1, wherein:

the portion to be ground is a tapered surface, and the grinding surface of the grinder is a conical surface contacting the tapered surface; and the coolant is injected to the tapered surface and the conical surface during the grinding operation.

4. The grinding apparatus as in claim 1, wherein:

the coolant is supplied toward the grinder through an inside of the work.

5. The grinding apparatus as in claim 4, wherein:

the work includes a passage through which the coolant is supplied.

6. The grinding apparatus as in claim 1, further including means for counting the number of works that have been ground by the grinding apparatus, and means for supplying the coolant for removing the sludge only when the number of works ground exceeds a predetermined number.

7. The grinding apparatus as in claim 6, further including brush device for removing the sludge on the grinding surface when the number of the works ground is less than the predetermined number.

8. The grinding apparatus as in claim 2, further including means for controlling the pressure of the coolant.

9. A method of grinding a portion of a work to be ground by a grinder, the method comprising:

grinding the portion to be ground while supplying coolant thorugh a passage in the work to the portion to be ground and the grinder; and supplying the coolant to the grinder while the grinder is leaving the portion to be ground and returning to its original position after grinding operation is completed to thereby remove sludge on the grinder, wherein the grinder, the work and the passage are coaxially aligned, and the grinder engages the work around an entirety of an opening of the passage when the work is being ground.

10. The method of grinding as in claim 9, wherein:

a pressure of the coolant supplied for removing the sludge on the grinder is set to a higher level than a pressure of the coolant supplied during the grinding operation.

11. The method of grinding as in claim 9, wherein:

the portion to be ground is a tapered surface, and the grinder has a grinding surface in a conical shape; and the coolant is injected to the tapered surface and the conical surface during grinding operation.

12. The method of grinding as in claim 9, wherein:

the coolant is supplied toward the grinder through an inside of the work.

13. The method of grinding as in claim 12, wherein: the work includes a passage through which the coolant is supplied.

14. The method of grinding as in claim 9, wherein:

the number of works ground is counted, and the coolant for removing sludge on the grinder is supplied only when the number of works ground exceeds a predetermined number.

15. The method of grinding as in claim 14, wherein:

sludge on the grinder is removed by brushing when the number of works ground is less than the predetermined number.

* * * * *